United States Patent [19]

Osawa et al.

[11] Patent Number: 5,036,814

[45] Date of Patent: Aug. 6, 1991

[54] ENGINE SPEED CONTROLLING APPARATUS FOR INTERNAL COMBUSTION ENGINE

[75] Inventors: Masataka Osawa; Takahito Kondo, both of Aichi, Japan

[73] Assignees: Kabushiki Kaisha Toyoto Chuo Kenkyusho, Aichi; Kabushiki Kaisha Toyoda Jidoshokki Seisakusho, Kariya, both of Japan

[21] Appl. No.: 510,563

[22] Filed: Apr. 18, 1990

[30] Foreign Application Priority Data

Apr. 20, 1989 [JP] Japan ..... 1-100812

[51] Int. Cl.[5] ..... F02D 31/00

[52] U.S. Cl. ..... 123/352

[58] Field of Search ..... 123/352, 339, 350; 364/426.04

[56] References Cited

U.S. PATENT DOCUMENTS

| | | | |
|---|---|---|---|
| 4,833,612 | 5/1989 | Okuno et al. | 364/426.04 |
| 4,843,553 | 6/1989 | Ohata | 364/426.04 |
| 4,860,707 | 8/1989 | Ohata | 123/352 |
| 4,877,002 | 10/1989 | Shimomura et al. | 123/352 |
| 4,898,137 | 2/1990 | Fujita et al. | 123/352 |

FOREIGN PATENT DOCUMENTS

| | | |
|---|---|---|
| 57-98811 | 6/1982 | Japan . |
| 63-118813 | 5/1988 | Japan . |

*Primary Examiner*—Raymond A. Nelli

*Attorney, Agent, or Firm*—Oblon, Spivak, McClelland, Maier & Neustadt

[57] ABSTRACT

An engine speed controlling apparatus for an internal combustion engine for controlling the engine speed of an internal combustion engine which has a mechanism for governing the engine speed and in which a manipulated variable of the governing mechanism and torque are in non-linear relationships. Although a real manipulated variable and the torque are in non-linear relationships, a virtual manipulated variable in which an actual engine speed becomes a targeted engine speed is calculated assuming those relationships as being linear. The virtual manipulated variable is converted to the real manipulated variable by using the actual non-linear relationships between the real manipulated variable and the torque, and the governor is controlled on the basis of the converted real manipulated variable.

18 Claims, 7 Drawing Sheets

INTERNAL COMBUSTION ENGINE
LOAD
ENGINE SPEED
SENSOR OUTPUT
TARGETED ENGINE SPEED
LEVER OPENING
ACTUATOR DRIVING SIGNAL
REAL MANIPULATED VARIABLE
VIRTUAL MANIPULATED VARIABLE
10
12
14
16
18
20
22
24
26
28
30
32
34
36
38
40
42
44
46
50

ENGINE SPEED CONTROLLING APPARATUS FOR INTERNAL COMBUSTION ENGINE

BACKGROUND OF THE INVENTION

1. Field of the Invention

The present invention relates to an engine speed controlling apparatus for an internal combustion engine, and more particularly to an engine speed controlling apparatus for controlling the engine speed of an internal combustion engine mounted on an industrial vehicle such as a fork lift or on an internal combustion engine used as a power source such as a generator.

2. Description of the Related Art

In an internal combustion engine mounted on an industrial vehicle such as a fork lift or the like, since the cargo load acts in addition to the traveling load, it is necessary to prevent a change in the traveling load from hindering the loading and unloading operations and a change in the cargo load from hindering the traveling of the vehicle. In addition, an internal combustion engine used as a power source such as a generator is required to supply electric power on a stable basis. Various controlling apparatuses have hitherto been developed with a view to running such an internal combustion engine at a speed in the vicinity of a targeted engine speed. As one of such controlling apparatuses, a method is known in which the dynamics of the internal combustion engine and the load is approximated and expressed as a linear transmission function around a certain operating point of each factor, and compensation is effected through proportional plus integral plus differential (PID) action control (refer to "The Report of Experiments on the Speed Governing of Diesel Engine-Generator", Transactions of the Japan Society of Mechanical Engineers (Part 1) Vol. 43, No. 367, page 957, line 13 of the left column to line 1 of the right column).

With the above-described conventional art, however, since the control system is designed by using characteristics of the internal combustion engine around certain operating points, there arises a need to design the control system for each operating point and effect control by changing over to an operation expression for control with respect to each operating point in conjunction with changes in the operating region of the internal combustion engine. Accordingly, this results in a problem such as an increased number of processes involved in designing the control system, and hunting which occurs in the engine speed at the time of making a changeover for control due to the discontinuity in expressions for control calculation.

SUMMARY OF THE INVENTION

Accordingly, an object of the present invention is to provide an engine speed controlling apparatus for an internal combustion engine which makes it possible to favorably control the actual engine speed to a targeted engine speed regardless of the operating region of the internal combustion engine, thereby overcoming the above-described drawbacks in the conventional art.

With this end, according to the present invention, there is provided an engine speed controlling apparatus for an internal combustion engine for controlling the engine speed of an internal combustion engine having a means for governing the engine speed and in which a manipulated variable of the governing means and torque are in non-linear relationships, the apparatus comprising: a detecting means for detecting actual engine speed; a calculating means for calculating a virtual manipulated variable in such a manner that the actual engine speed becomes a targeted engine speed assuming that a real manipulated variable of the governing means and torque are in linear relationships; a converting means for converting the virtual manipulated variable to the real manipulated variable by using the non-linear relationships between the real manipulated variable and the torque; and a controlling means for controlling the governing means on the basis of the real manipulated variable.

The present invention has been devised in the light of the following aspect. In other words, the variation in parameters due to a change in an operating point of an internal combustion engine in relation between engine speed and a real manipulated variable linearly approximated about the operating point is ascribable to a change in the gradient of the actual torque acting within the internal combustion engine with respect to the real manipulated variable. In addition, this gradient changes due to a change in the torque or engine speed of the internal combustion engine, but this change is continuous. Accordingly, if a control calculation is made assuming that the gradient is fixed by disregarding the change in the gradient, i.e., assuming that the manipulated variable and the torque are in linear relationships, and if compensation is then performed for the change in the gradient, it is possible to simplify control system design and secure excellent performance in stabilizing the engine speed over the entire running region of the internal combustion engine.

In accordance with this aspect, in the present invention, assuming that the manipulated variable and the torque are in linear relationships, the virtual manipulated variable is calculated by the calculating means in such a manner that actual engine speed detected by the detecting means becomes a targeted engine speed. Subsequently, the virtual manipulated variable is converted to the real manipulated variable by the converting means by using the actual non-linear relationships between the manipulated variable and the torque. The governing means for governing the engine speed of the internal combustion engine is controlled on the basis of this real manipulated variable.

As described above, in accordance with the present invention, since it is assumed that the manipulated variable and torque are in linear relationships, the dynamic relations between the virtual manipulated variable and the engine speed become identical over the entire operating region of the internal combustion engine. Hence, it is possible to obtain an advantage in that parameters of the control calculation are optimized at a certain operating point, and that the control system can therefore be simplified.

DESCRIPTION OF THE PREFERRED EMBODIMENTS

Figure 1:
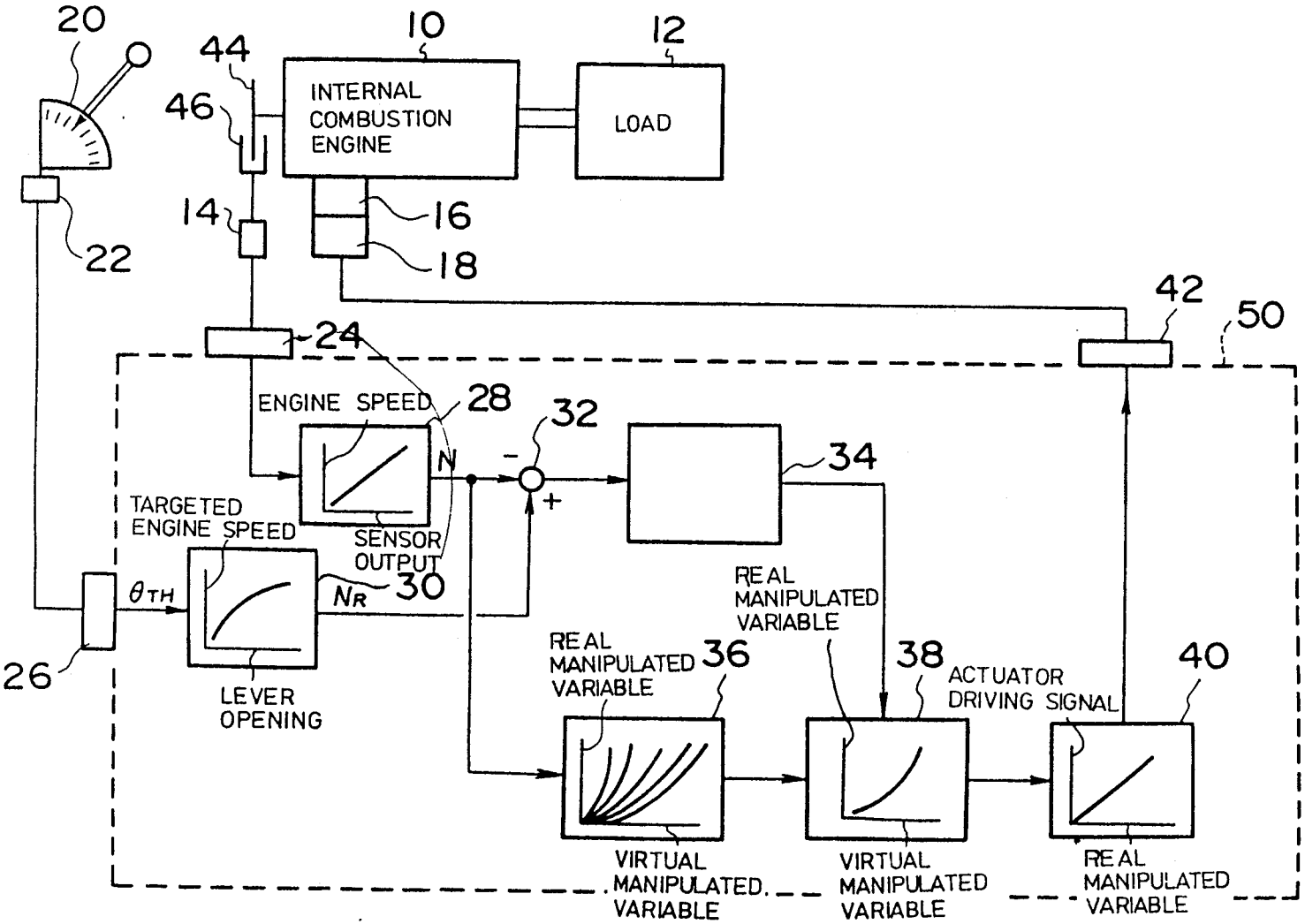
FIG. 1 is a block diagram in accordance with a first embodiment of the present invention.

Referring now to the accompanying drawings, a detailed description will be given of the preferred embodiments of the present invention. FIG. 1 illustrates a first embodiment in which a load system 12 for absorbing the output of an internal combustion engine 10 is connected to an output shaft of the engine 10. A disk 44 provided with a plurality of slits at equal intervals in a circumferential direction thereof is mounted on a rotating shaft (not shown) of the internal combustion engine 10. A detecting section 46 is constituted in such a manner as to sandwich the disk 44 with a light-emitting device and a light-receiving device. The detecting section 46 is connected to an input interface 24 via an engine speed detector 14. The internal combustion engine 10 is provided with an output governing means 16 for governing the output of the internal combustion engine by controlling the amount of air intake or the amount of fuel injected into a cylinder (in the case of a diesel engine). The output governing means 16 is driven by an actuator 18 such as a stepping motor or the like that is connected to an output interface 42.

A lever opening detector 22 for detecting the opening of a lever is connected to a throttle lever 20 which sets the targeted engine speed of the internal combustion engine. The lever opening detector 22 is connected to an input interface 26. The interfaces 24, 26, 42 are connected to a control arithmetic unit 50 constituted by a microcomputer and the like. Alternatively, an arrangement may be provided in such a manner as to detect the throttle opening instead of the lever opening. The control arithmetic unit 50 is provided with an engine speed-calculating circuit 28 for calculating the actual engine speed N on the basis of a signal inputted from the input interface 24. An output terminal of the engine speed-calculating circuit 28 is connected to a deviation calculator 32 and a conversion relationship setter 36 for setting the relationship between a virtual manipulated variable and a real manipulated variable that correspond to the actual engine speed at the present time on the basis of a table shown in FIG. 5. Connected to the input interface 26 is a targeted engine speed-calculating circuit 30 for calculating targeted engine speed $N_R$ on the basis of a lever opening $\theta$TH inputted via the input interface 26. This targeted engine speed-calculating circuit 30 is connected to the deviation calculator 32. The output terminal of the deviation calculator 32 is connected to a virtual-to-real converting circuit 38 for converting the virtual manipulated variable to the real manipulated variable via a virtual control amount-calculating circuit 34. The virtual-to-real converting circuit 38 is connected to a driving signal-calculating circuit 40 for calculating a driving signal on the basis of a real manipulated variable. The driving signal calculated by the driving signal-calculating circuit 40 is inputted to the actuator 18 via the output interface 42.

Figure 2:
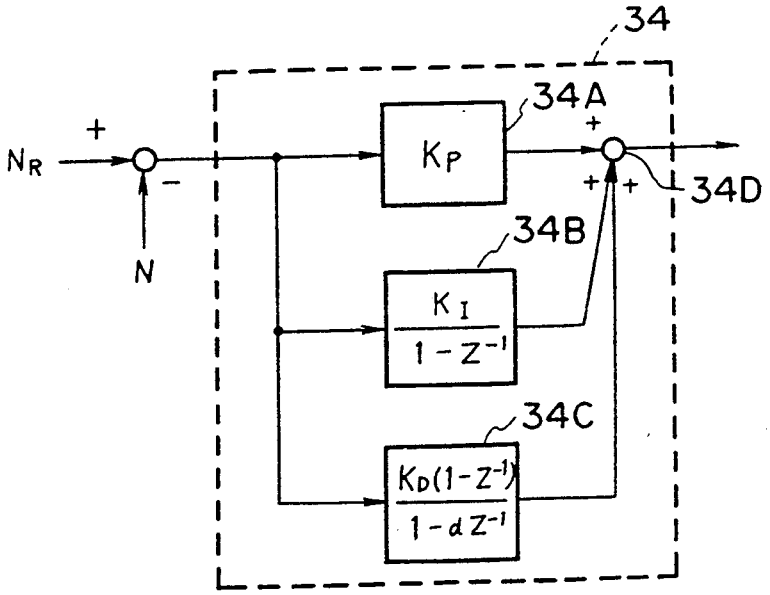
FIG. 2 is a block diagram illustrating the details of a virtual control amount-calculating circuit in accordance with the first embodiment.

As shown in FIG. 2, the aforementioned virtual control amount-calculating circuit 34 comprises a first transmitting element 34A for outputting a signal proportional to a deviation in which the actual engine speed N is subtracted from the targeted engine speed $N_R$, i.e., a deviation between the output of the targeted engine speed-calculating circuit 30 and the actual engine speed; a second transmitting element 34B for outputting a signal in which an amount proportional to this deviation is totalized at each timing, i.e., for each predetermined time; a third transmitting element 34C for determining a variation of the aforementioned deviation and outputting a signal provided with filtering processing for controlling excess fluctuations in the variation due to noise, a high-frequency engine speed variation and so forth; and an adder 34D for adding the signals from the first to third transmitting elements. A virtual manipulated variable signal is outputted from this adder 34D.

A description will now be given of the operation of the first embodiment. The engine speed-calculating circuit 28 outputs the actual engine speed N of the internal combustion engine 10 on the basis of the output of the engine speed detector 14. The targeted engine speed-calculating circuit 30 outputs a signal corresponding to the targeted engine speed $N_R$ on the basis of the output of the lever opening detector 22. The deviation calculator 32 calculates a deviation between the targeted engine speed $N_R$ and the actual engine speed N. This deviation is subjected to PID processing by the virtual control amount-calculating circuit 34 and is converted to a virtual manipulated variable, and is inputted to the virtual-to-real converting circuit 38.

Figure 5:
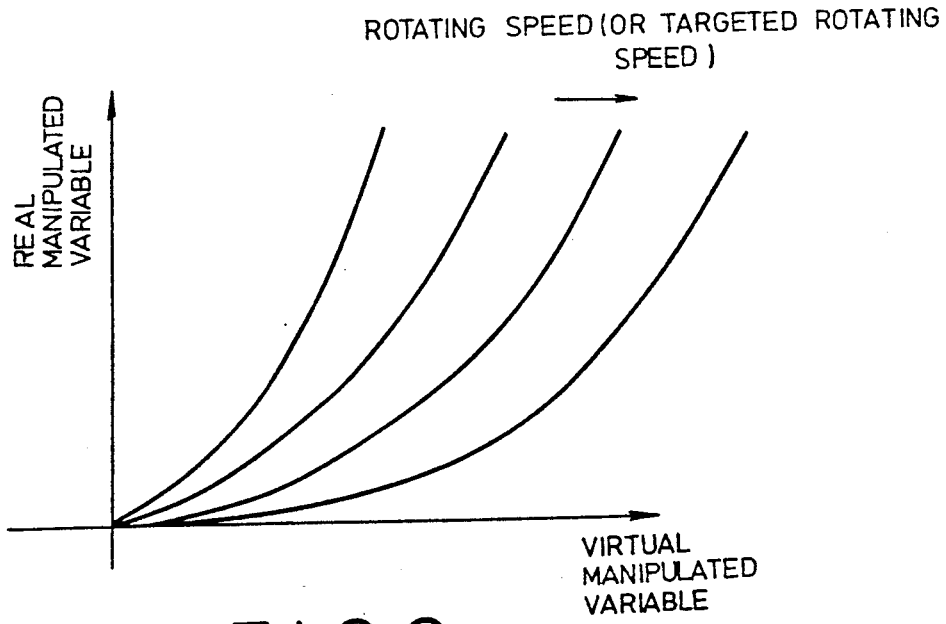
FIG. 5 is a diagram illustrating a table of a real manipulated variable and a virtual manipulated variable determined in correspondence with the engine speed or a targeted engine speed.
Figure 6:
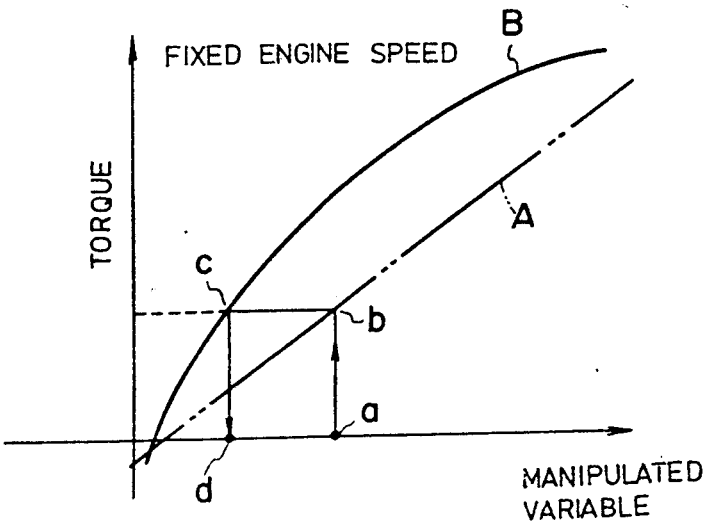
FIG. 6 is a diagram explaining the conversion of a virtual manipulated variable to an real manipulated variable.

A plurality of tables (see FIG. 5) which illustrate the relationships between the virtual manipulated variable and the real manipulated variable that correspond to each engine speed are stored in advance in the conversion relationship setter 36. Specifically, the conversion relationship setter 36 selects one of the tables illustrating the conversion relationship between the virtual manipulated variable and the real manipulated variable corresponding to the actual engine speed N at the present time outputted from the engine speed-calculating circuit 28, and sets the same in the virtual-to-real converting circuit 38. Here, as shown in FIG. 6, if the engine speed is assumed to be fixed, the real control amount-torque characteristics are non-linear, as indicated by a curve B. For this reason, assuming virtual control amount-torque characteristics to be linear as indicated by straight line A, by converting the real manipulated variable to the virtual manipulated variable on the basis of straight line A and curve B, the relationships between the virtual manipulated variable and the real manipulated variable corresponding to the engine speed that are shown in FIG. 5 are determined. That is, if it is assumed that the virtual manipulated variable is at point a, the torque in terms of the virtual control amount-torque characteristics (on the straight line A) is at point b, and the point in terms of characteristics of the real manipulated variable with the same torque as at point b versus torque is point c. The real manipulated variable corresponding to point c is point d. Accordingly, the real manipulated variable corresponding to the virtual manipulated variable at point a becomes the value of point d. Hence, if the relationships between the virtual manipulated variable and the real manipulated variable are determined by changing the engine speed, the table shown in FIG. 5 can be obtained.

In the virtual-to-real converting circuit 38, the virtual manipulated variable calculated by the virtual control amount-calculating circuit 34 is converted to the real manipulated variable on the basis of the relationships between the virtual manipulated variable and the real manipulated variable corresponding to the actual engine speed at the present time which have been set by the conversion relationship setter 36. Then, in the driving signal-calculating circuit 40, a driving signal of the actuator corresponding to the real manipulated variable is determined, and the actuator 18 is controlled via the output interface 42, thereby controlling the output governing means 16. As a result, control is effected in such a manner that even if torque fluctuates due to variations in the load system 12, the actual engine speed becomes the targeted engine speed.

In accordance with this embodiment, since the PID control of the virtual control amount-calculating circuit 34 is effected on the basis of the virtual manipulated variable which is in linear relationships with the torque, it becomes unnecessary to change over a control arithmetic expression based on a control amount, so that it is possible to obtain an advantage in that the control arithmetic expression is simplified and controllability is enhanced.

Figure 3:
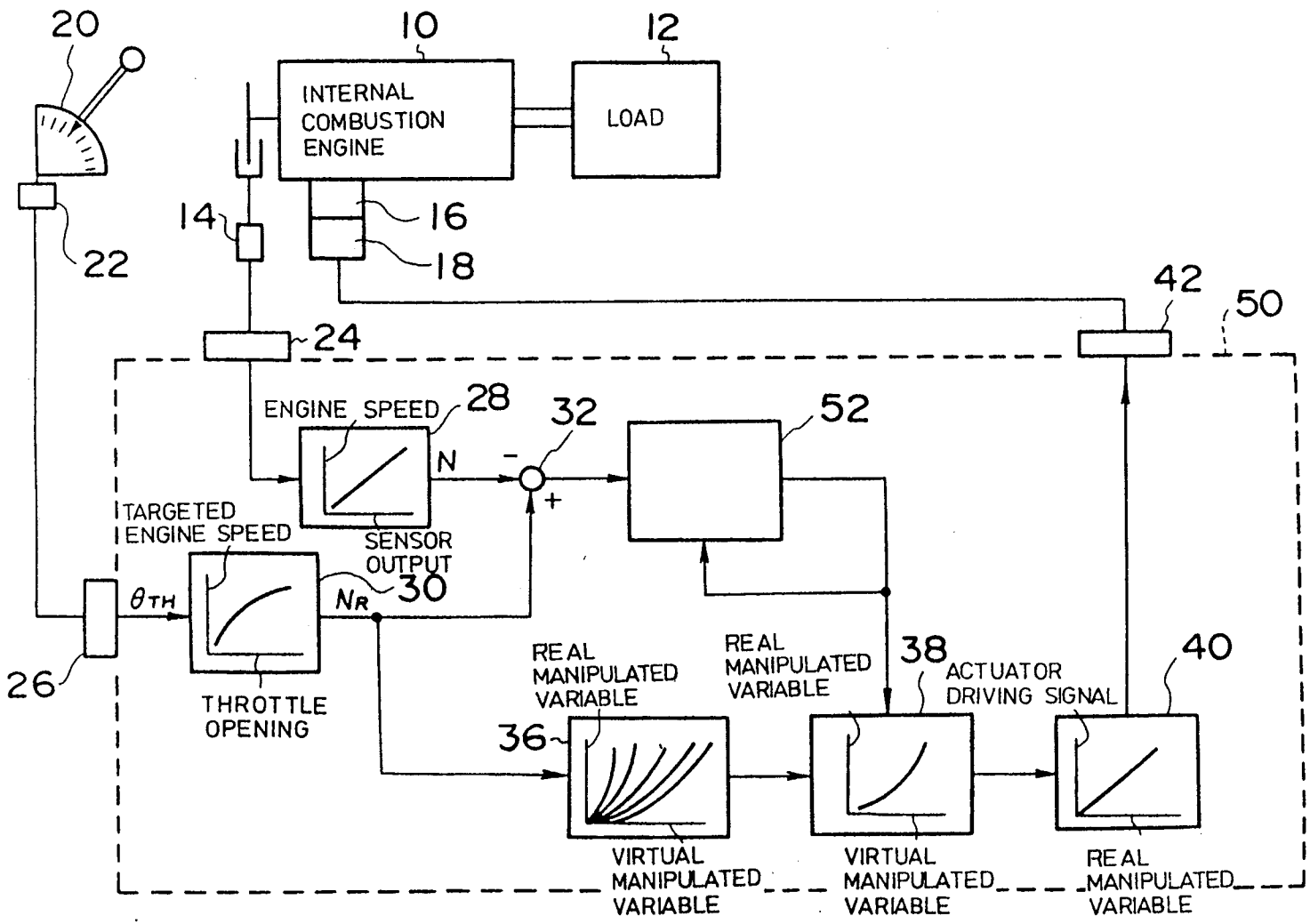
FIG. 3 is a block diagram of a second embodiment of the present invention.

Referring now to FIG. 3, a description will be given of a second embodiment of the present invention. In FIG. 3, components that are similar to those of FIG. 1 are denoted by the same reference numerals, and a description thereof will be omitted. As shown in FIG. 3, the targeted engine speed-calculating circuit 30 is connected to the conversion relationship setter 36 so as to set the conversion relationships between the virtual manipulated variable and the real manipulated variable on the basis of the targeted engine speed $N_R$. In addition, a control arithmetic unit 52 for effecting observer plus state feedback control is used instead of the virtual control amount-calculating circuit 34 shown in FIG. 1. In this observer plus state feedback control, dynamics of both the virtual manipulated variable and the engine speed are assumed to be a sum of a wasteful time and a secondary delay system (in the case of a gasoline engine), and this sum is expressed by a state equation of the following formula, and a feedback gain in each state is determined by solving Riccati's formula:

$$\dot{x}=Ax+bu \quad (1)$$

Figure 4:
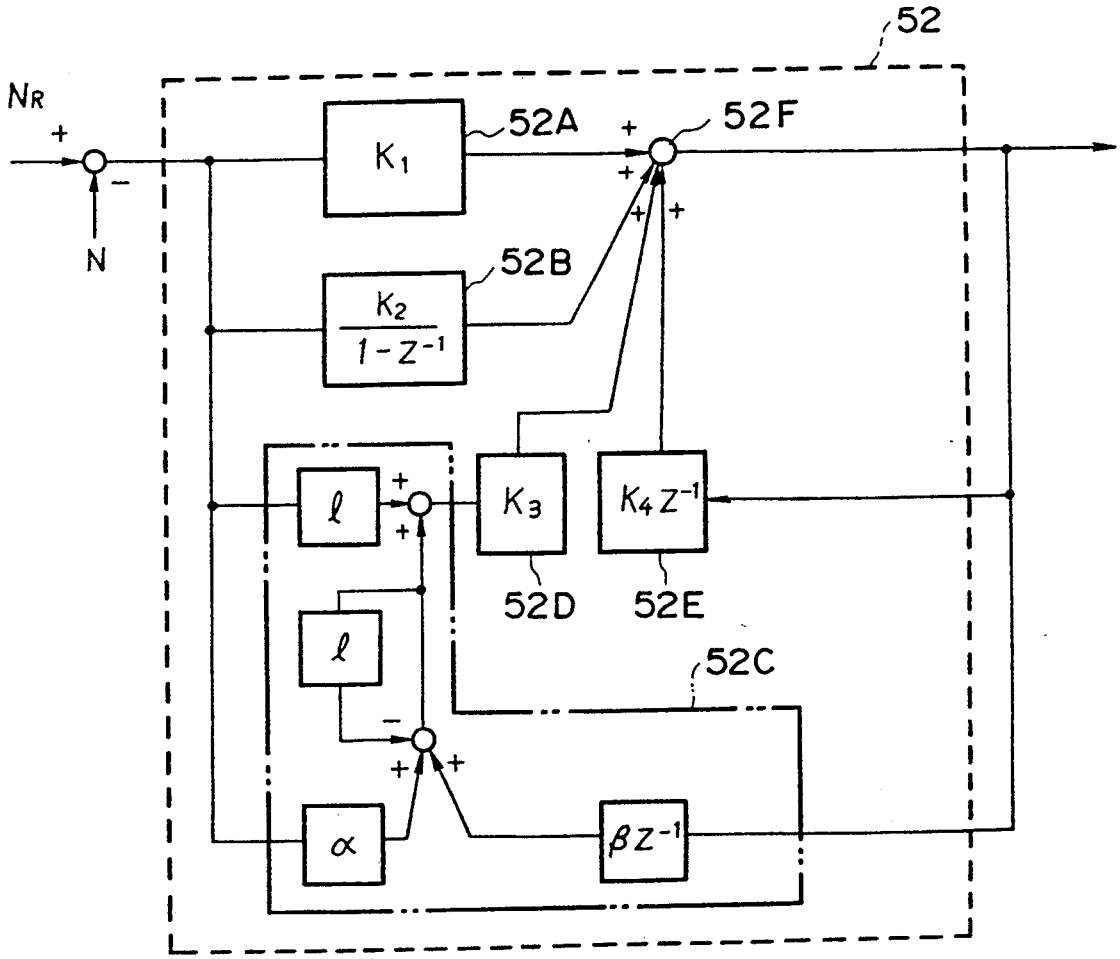
FIG. 4 is a block diagram illustrating the details of the virtual control amount-calculating circuit in accordance with the second embodiment.

As shown in FIG. 4, the control arithmetic unit 52 comprises a first transmitting element 52A for outputting a signal proportional to a deviation between the targeted engine speed and the actual engine speed; a second transmitting element 52B for outputting a signal in which an amount proportional to this deviation is totalized at each timing; a third transmitting element 52C for estimating an amount of state on the basis of the deviation and the virtual manipulated variable before a timing, i.e., before a unit timing; a fourth transmitting element 52D for outputting a signal proportional to the amount of state estimated by the third transmitting element 52C; a fifth transmitting element 52E for outputting the virtual manipulated variable before the timing; and an adder 52F for adding them.

In this second embodiment, a plurality of tables illustrating the relationship between the virtual manipulated variable and the real manipulated variable determined in correspondence with a targeted engine speed, as shown in FIG. 5, are stored in the conversion relationship setter 36 in advance. An appropriate relationship between the virtual manipulated variable and the real manipulated variable corresponding to the targeted engine speed calculated by the targeted engine speed-calculating circuit 30 is selected and is set in the virtual-to-real converting circuit 38. Then, the virtual-to-real converting circuit 38 converts the virtual manipulated variable calculated by the control arithmetic unit 52 to the real manipulated variable, and the output governing means 16 is controlled in the same way as the first embodiment.

In accordance with this embodiment, since complicated control such as observer plus state feedback control is effected by the control arithmetic unit, the simplification of values of control calculation by virtue of the virtual manipulated variable becomes more effective than in the case of the first embodiment. In addition, it is possible to obtain an advantage in that controllability is enhanced since the conversion relationships between the virtual manipulated variable and the real manipulated variable are determined in correspondence with the targeted engine speed.

Figure 9:
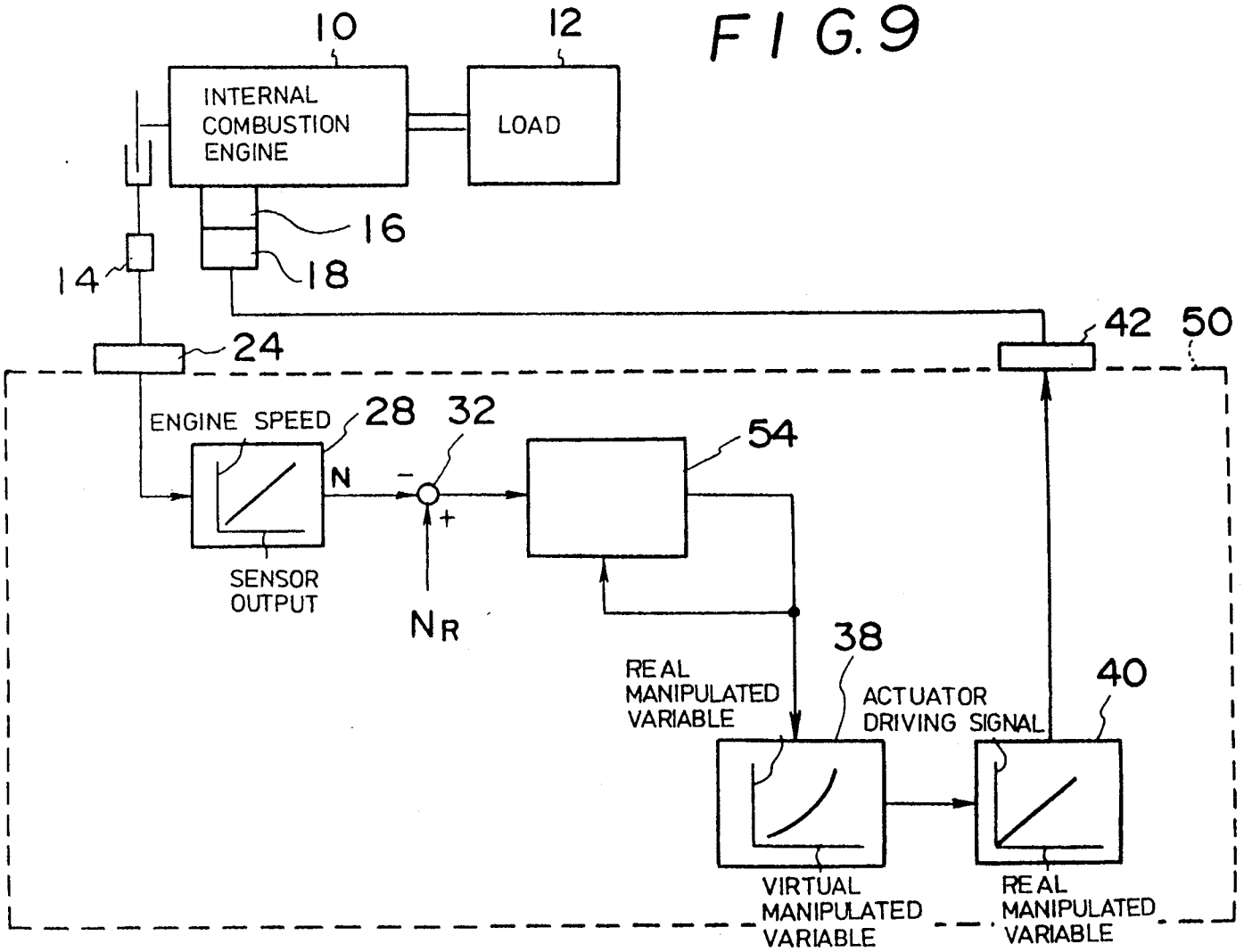
FIG. 9 is a block diagram in accordance with a third embodiment of the present invention.

Referring now to FIG. 9, a description will be given of a third embodiment of the present invention. In this embodiment, the present invention is applied to controlling the rotation of an internal combustion engine used as a power source such as a generator. For this purpose, the throttle lever 20 for setting the targeted engine speed, the engine speed-calculating circuit 28, and the conversion relationship setter 36 for setting the conversion relationships between the virtual manipulated variable and the real manipulated variable are omitted, and a sole conversion relationship between the virtual manipulated variable and the real manipulated variable that correspond to a predetermined targeted engine speed is set in the virtual-to-real converting circuit 38. A virtual control amount-calculating circuit 54 effects calculation for PID processing referred to in the first embodiment or observer plus state feedback control referred to in the second embodiment.

In accordance with this embodiment, a fixed targeted engine speed $N_R$ is set in advance, and the relationship between the virtual manipulated variable and the real manipulated variable that correspond to the targeted speed is stored in the virtual-to-real converting circuit 38. In this virtual-to-real converting circuit 38, the virtual manipulated variable calculated by the virtual control amount-calculating circuit 54 is converted to the real manipulated variable, and the output governing means 16 is controlled in the same way as the above-described embodiments.

In accordance with this embodiment, the throttle lever for setting the target engine speed, the engine speed-calculating circuit for calculating the targeted engine speed, and the conversion relationship setter for setting the conversion relationships between the virtual manipulated variable and the real manipulated variable corresponding to the engine speed are omitted. Accordingly, advantages can be obtained in that the controlling apparatus is simplified, and that it is readily possible to realize an engine speed controlling apparatus for an internal combustion engine used as a power source for imparting fixed-speed rotation e.g. a generator.

Figure 7:
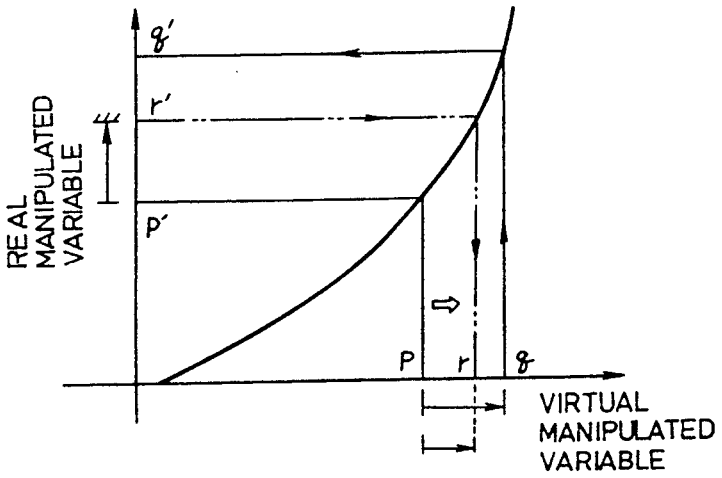
FIG. 7 is a diagram explaining the magnitude of the virtual manipulated variable in cases where the real manipulated variable is restricted.
Figure 8:
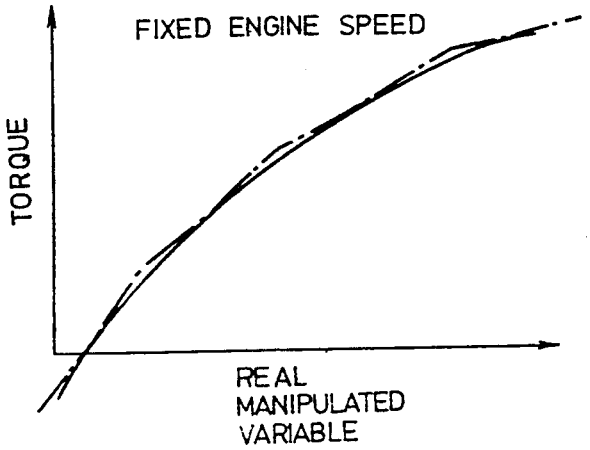
FIG. 8 is a diagram illustrating relationships between the manipulated variable and torque.

A description will now be given of a case where there are limitations to the variation during a fixed time of the output governing means in an internal combustion engine in the first to third embodiments (for instance, limitations due to the response characteristics of the stepping motor). In this case, inconsistency in a control calculation is eliminated by adding the following calculation. That is, as shown in FIG. 7, if a description is given of a case where the virtual manipulated variable before a certain timing is p, the virtual manipulated variable at the present time calculated by the virtual control amount-calculating circuit 34 or 52 is q, and the real manipulated variable corresponding to the respective cases are p' and q', and the variation from p' to q' is restricted by r', a virtual manipulated variable r corresponding to the real manipulated variable r' is determined, and this virtual manipulated variable r is used for calculation at a next timing as the virtual manipulated variable at the present time.

It should be noted that although in the foregoing description an explanation has been given of an example in which the real manipulated variable and the like are calculated by using a table, the calculation may be made by means of an expression.

What is claimed is:

1. An engine speed controlling apparatus for an internal combustion engine for controlling an engine speed of an internal combustion engine which has a means for governing engine speed and in which a manipulated variable of said governing means and torque are in non-linear relationships, said apparatus comprising:

detecting means for detecting an actual engine speed;

calculating means for calculating a virtual manipulated variable in such a manner that the actual engine speed becomes a targeted engine speed;

converting means for converting the virtual manipulated variable to a real manipulated variable by using the non-linear relationships between the real manipulated variable of said governing means and torque; and controlling means for controlling said governing means on the basis of the real manipulating variable.

2. An engine speed controlling apparatus for an internal combustion engine according to claim 1, wherein said calculating means calculates the virtual manipulated variable which is in linear relationships with said torque.

3. An engine speed controlling apparatus for an internal combustion engine according to claim 2, wherein said calculating means determines the virtual manipulated variable by a calculation for effecting proportional plus integral plus derivative action control on the basis of a deviation between the actual engine speed and the targeted engine speed.

4. An engine speed controlling apparatus for an internal combustion engine according to claim 2, wherein said calculating means determines the virtual manipulated variable by a calculation for effecting observer plus state feedback control on the basis of a deviation between the actual engine speed and the targeted engine speed.

5. An engine speed controlling apparatus for an internal combustion engine according to claim 2, wherein said converting means comprises a setting circuit for setting the relationships between the virtual manipulated variable and the real manipulated variable that correspond to one of the actual engine speed at the present time and a targeted engine speed at the present time; and a converting circuit for converting to a real manipulated variable the virtual manipulated variable calculated by said calculating means by using the relationships between the virtual manipulated variable and the real manipulated variable set by said setting circuit.

6. An engine speed controlling apparatus for an internal combustion engine according to claim 5, wherein said setting circuit sets the relationships between the virtual manipulated variable and the real manipulated variable by selecting a table corresponding to one of the actual engine speed at the present time and the targeted engine speed at the present time from among a plurality of tables showing the relationships between the virtual manipulated variable and the real manipulated variable that correspond to one of the actual engine speed and the targeted engine speed.

7. An engine speed controlling apparatus for an internal combustion engine according to claim 2, wherein said converting means converts the virtual manipulated variable calculated by said calculating means by using the relationships between the virtual manipulated variable and the real manipulated variable that correspond to a predetermined targeted engine speed.

8. An engine speed controlling apparatus for an internal combustion engine according to claim 2, wherein said converting means converts the virtual manipulated variable to the real manipulated variable by using the non-linear relationships between the real manipulated variable and the torque and the linear relationships between the virtual manipulated variable and the torque.

9. An engine speed controlling apparatus for an internal combustion engine according to claim 5, wherein the relationships between the virtual manipulated variable and the real manipulated variable are determined on the basis of the non-linear relationships between the real manipulated variable and the torque and the linear relationships between the virtual manipulated variable and the torque.

10. An engine speed controlling apparatus for an internal combustion engine according to claim 6, wherein the relationships between the virtual manipulated variable and the real manipulated variable are determined on the basis of the non-linear relationships between the real manipulated variable and the torque and the linear relationships between the virtual manipulated variable and the torque.

11. An engine speed controlling apparatus for an internal combustion engine according to claim 7, wherein the relationships between the virtual manipulated variable and the real manipulated variable are determined on the basis of the non-linear relationships between the real manipulated variable and the torque and the linear relationships between the virtual manipulated variable and the torque.

12. An engine speed controlling apparatus for an internal combustion engine according to claim 5, wherein the relationships between the virtual manipulated variable and the real manipulated variable are determined in such a manner that the magnitude of the real manipulated variable with respect to the virtual manipulated variable becomes smaller as one of the actual engine speed and the targeted engine speed becomes greater.

13. An engine speed controlling apparatus for an internal combustion engine according to claim 6, wherein the relationships between the virtual manipulated variable and the real manipulated variable are determined in such a manner that the magnitude of the real manipulated variable with respect to the virtual manipulated variable becomes smaller as one of the actual engine speed and the targeted engine speed becomes greater.

14. An engine speed controlling apparatus for an internal combustion engine according to claim 7, wherein the relationships between the virtual manipulated variable and the real manipulated variable are determined in such a manner that the magnitude of the real manipulated variable with respect to the virtual manipulated variable becomes smaller as one of the actual engine speed and the targeted engine speed becomes greater.

15. An engine speed controlling apparatus for an internal combustion engine according to claim 2, wherein said governing means governs the engine speed of said internal combustion engine by governing one of an air intake and an amount of fuel injection.

16. An engine speed controlling apparatus for an internal combustion engine according to claim 2, further comprising: an opening detecting means for detecting one of an opening of throttle lever and a throttle opening; and a computing means for computing the targeted engine speed on the basis of an output of said opening detecting means.

17. An engine speed controlling apparatus for an internal combustion engine according to claim 2, wherein said calculating means includes a first transmitting element for outputting a signal proportional to a deviation between the actual engine speed and the targeted engine speed; a second transmitting element for outputting a signal in which an amount proportional to the deviation is totalized at each timing; a third transmitting element for determining a variation of the deviation and outputting a signal provided with filtering processing for controlling excess fluctuations in the variation; and an adder for adding the signals from said first to third transmitting elements.

18. An engine speed controlling apparatus for an internal combustion engine according to claim 2, wherein said calculating means includes a first transmitting element for outputting a signal proportional to a deviation between the actual engine speed and the targeted engine speed; a second transmitting element for outputting a signal in which an amount proportional to the deviation is totalized at each timing; a third transmitting element for estimating an amount of state on the basis of the deviation and the virtual manipulated variable before each unit timing; a fourth transmitting element for outputting a signal proportional to the amount of state estimated by said third transmitting element; a fifth transmitting element for outputting the virtual manipulated variable before the unit timing; and an adder for adding the signals from said first to fifth transmitting elements.

* * * * *

UNITED STATES PATENT AND TRADEMARK OFFICE

CERTIFICATE OF CORRECTION

PATENT NO. : 5,036,814

DATED : August 6, 1991

INVENTOR(S) : Masataka Osawa et al.

It is certified that error appears in the above-identified patent and that said Letters Patent is hereby corrected as shown below:

ON THE TITLE PAGE:

The First Assignee is incorrect, should be, --Kabushiki Kaisha Toyota Chuo Kenkyusho, Aichi, Japan--.

Signed and Sealed this

Ninth Day of February, 1993

*Attest:*

STEPHEN G. KUNIN

*Attesting Officer*

*Acting Commissioner of Patents and Trademarks*